US012336648B1

(12) United States Patent
Yu

(10) Patent No.: US 12,336,648 B1
(45) Date of Patent: Jun. 24, 2025

(54) CUP HOLDER TRAY

(71) Applicant: Chun-Yin Yu, Changhua County (TW)

(72) Inventor: Chun-Yin Yu, Changhua County (TW)

( * ) Notice: Subject to any disclaimer, the term of this patent is extended or adjusted under 35 U.S.C. 154(b) by 0 days.

(21) Appl. No.: 18/888,492

(22) Filed: Sep. 18, 2024

(30) Foreign Application Priority Data

Dec. 26, 2023 (TW) ..... 112150873

(51) Int. Cl.
*A47G 19/00* (2006.01)
*A47G 23/06* (2006.01)

(52) U.S. Cl.
CPC ..... *A47G 23/0641* (2013.01)

(58) Field of Classification Search
CPC ..... A47G 23/0641; A47G 23/0625; A47G 23/0208; A47G 23/06; A47G 23/0225; A47G 23/0633; A47G 23/08; A47G 19/065; A47G 19/06; A47G 19/08; A47G 19/02; B65D 1/34
USPC ..... 206/562, 563, 426, 557, 737, 815
See application file for complete search history.

(56) References Cited

U.S. PATENT DOCUMENTS

D182,396 S * 4/1958 Berry ..... A47G 19/06 D7/553.8
5,114,038 A * 5/1992 Laumann geb. Quensen ..... A47G 19/065 220/575
5,419,455 A * 5/1995 Russeau ..... A47G 19/06 206/564
5,519,593 A * 5/1996 Hasness ..... F21V 21/0965 362/186
7,000,799 B1 * 2/2006 Hamre ..... A47G 19/065 220/575
2007/0095827 A1 * 5/2007 Ingle ..... A47G 19/065 220/23.83
2015/0182054 A1 * 7/2015 Shames ..... A47G 23/0625 206/217

* cited by examiner

*Primary Examiner* — King M Chu
(74) *Attorney, Agent, or Firm* — Muncy, Geissler, Olds & Lowe, P.C.

(57) ABSTRACT

A tray capable of holding a stemmed glass comprises a main portion, a first extending portion, a second extending portion, and an offset channel. The main portion includes a through hole, a hole edge surrounding the through hole, and a notch defined by two ends of the hole edge, with the notch communicating with the through hole. The first extending portion extends from the main portion and is located on one side of a radial centerline of the through hole in the main portion. The second extending portion extends from the main portion and is located on the opposite side of the radial centerline. The offset channel is defined by an inner edge of the first extending portion and an inner edge of the second extending portion, with one end of the offset channel communicating with the notch in the main portion and the other end forming an opening.

4 Claims, 7 Drawing Sheets

CUP HOLDER TRAY

FIELD OF THE INVENTION

The present invention relates to a tray for holding food, and more specifically to a tray that can accommodate cups.

BACKGROUND OF THE INVENTION

At some events such as banquets or cocktail parties, it is common to see people elegantly sipping wine from stemmed glasses while engaging in conversation, exuding an air of grace and sophistication. However, maintaining this appearance becomes challenging when one needs to retrieve or enjoy pastries. Holding a stemmed glass in one hand while also carrying a small plate with pastries can be difficult and inevitably leads to awkward situations, making it hard to maintain composure.

SUMMARY OF THE INVENTION

The present invention provides a tray capable of holding a cup, which not only serves the function of holding food but also includes features for securely holding a stemmed glass and preventing it from slipping out on its own. This allows users to confidently use the tray to place both food (e.g., pastries) and beverages (e.g., red wine), and to elegantly and comfortably engage in dining and social interactions without discomfort.

More specifically, the tray of the present invention comprises a main portion, a first extending portion, a second extending portion, and an offset channel. The main portion features a through hole, a hole edge surrounding the through hole, and a notch defined by the two ends of the hole edge. The notch communicates with the through hole. The first extending portion extends from the main portion and is located on one side of the radial centerline of the through hole of the main portion. The second extending portion extends from the main portion and is positioned on the opposite side of the radial centerline. The offset channel is defined by the inner edge of the first extending portion and the inner edge of the second extending portion, with one end of the offset channel communicating with the notch of the main portion and the other end of the offset channel forming an opening.

In one embodiment, the first extending portion of the tray according to the present invention is inclined upward. Preferably, a sharp angle is formed between the first extending portion and the second extending portion.

In one embodiment, the center point of the through hole in the tray of the present invention is located on the radial centerline, whereas the center point of the opening is not located on the radial centerline.

In one embodiment, a portion of the inner edge of the first extending portion of the tray according to the present invention extends beyond the radial centerline.

In one embodiment, the width of the offset channel in the tray of the present invention gradually decreases and then gradually increases from the notch towards the opening.

In one embodiment, the distance between the inner edge of the first extending portion and the radial centerline is closer, whereas the distance between the inner edge of the second extending portion and the radial centerline is farther.

In one embodiment, a top surface of the main portion of the tray, a top surface of the first extending portion, and a top surface of the second extending portion of the tray are coextensive with each other.

In one embodiment, the tray of the present invention further includes a blocking wall that protrudes upward from the top surface of the main portion, with the ends of the blocking wall extending into the top surfaces of the first extending portion and the second extending portion, respectively. Preferably, the height of the blocking wall decreases gradually from the first extending portion towards the second extending portion, and the width of the top of the blocking wall narrows gradually from the second extending portion towards the first extending portion.

DETAILED DESCRIPTION OF THE INVENTION

Figure 1:
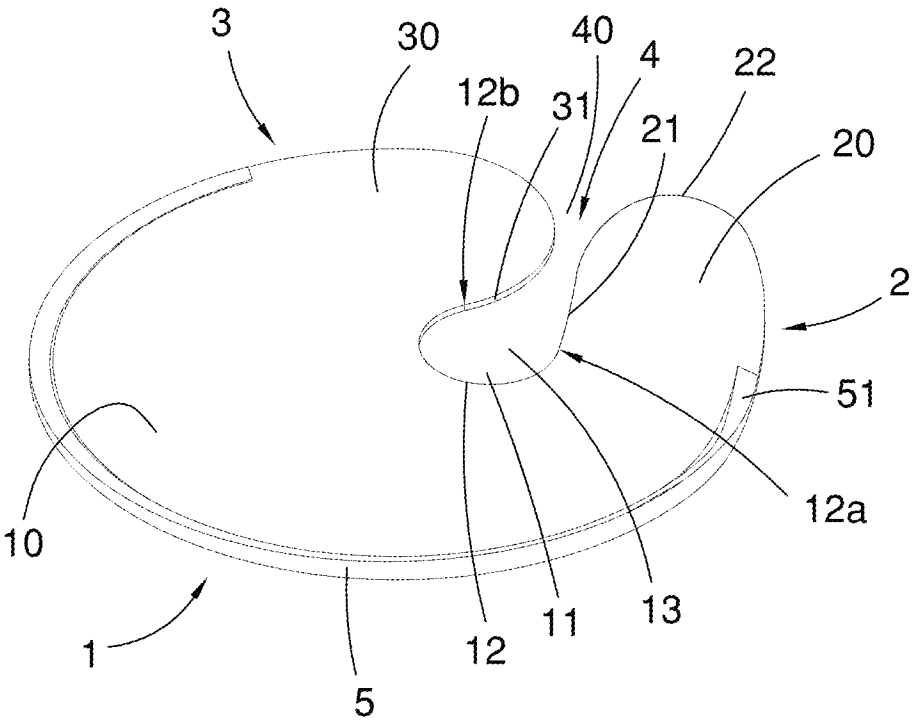
FIG. 1 shows a perspective view of an embodiment of the tray of the present invention.
Figure 2:
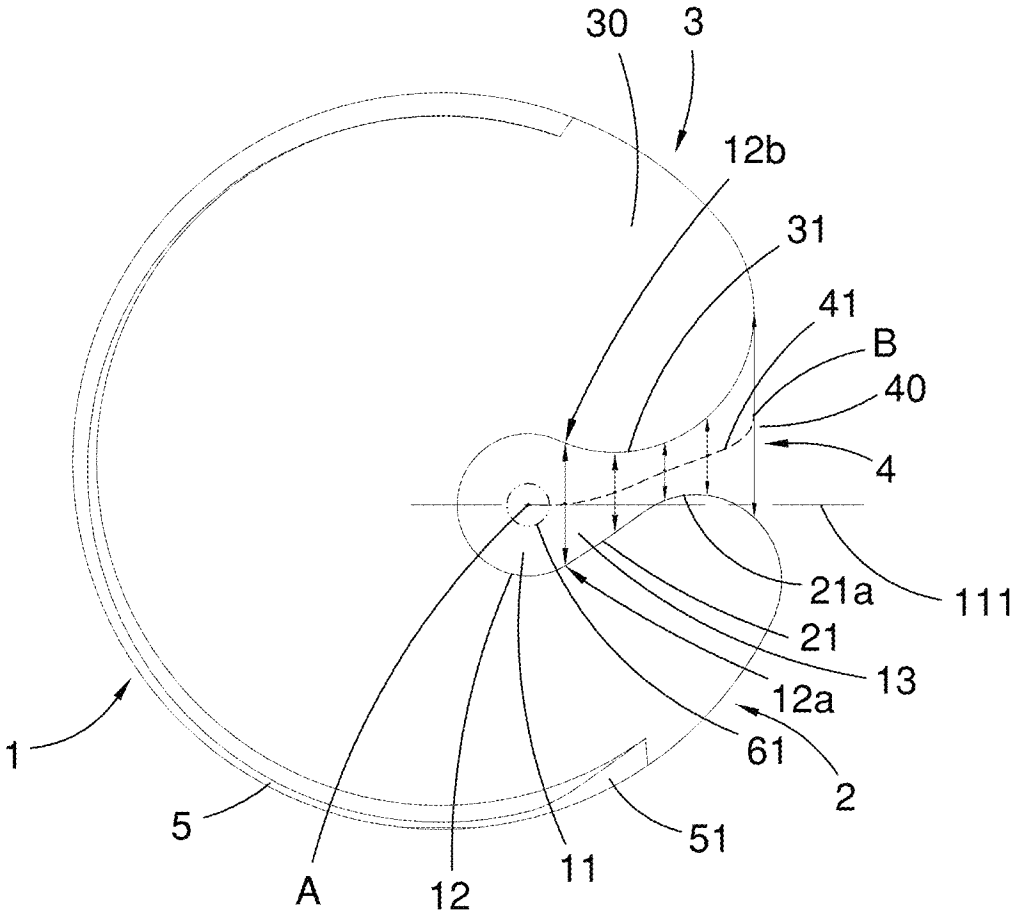
FIG. 2 shows a top view of the embodiment of the tray of the present invention.

FIGS. 1 and 2 illustrate an embodiment of the tray of the present invention. In this embodiment, the tray includes a main portion 1, a first extending portion 2, a second extending portion 3, and an offset channel 4. The main portion 1 has a through hole 11, a hole edge 12 surrounding the through hole 11, and a notch 13 defined by the ends 12*a* and 12*b* of the hole edge 12, with the notch 13 being in communication with the through hole 11. The first extending portion 2 extends from the main portion 1 and is located on one side of a radial centerline 111 of the through hole 11. The radial centerline 111 is a straight line radiating outwardly from a center point A of the through hole 11. The second extending portion 3 extends from the main portion 1 and is located on the opposite side of the radial centerline 111. The offset channel 4 is defined by the inner edge 21 of the first extending portion 2 and the inner edge 31 of the second extending portion 3, with one end of the offset channel 4 being in communication with the notch 13 of the main portion 1, and the other end of the offset channel 4 forming an opening 40.

As shown in FIG. 2, a central axis 41 formed by multiple central points of the offset channel 4 is evidently not a straight line that faithfully follows the radial centerline 111 but rather a path that deviates from the radial centerline 111. Therefore, the center point B of the opening 40 (i.e., the end of the central axis 41) is not on the same horizontal line as the center point A of the through hole 11, meaning that the center point B of the opening 40 has deviated from the radial centerline 111.

Figure 3:
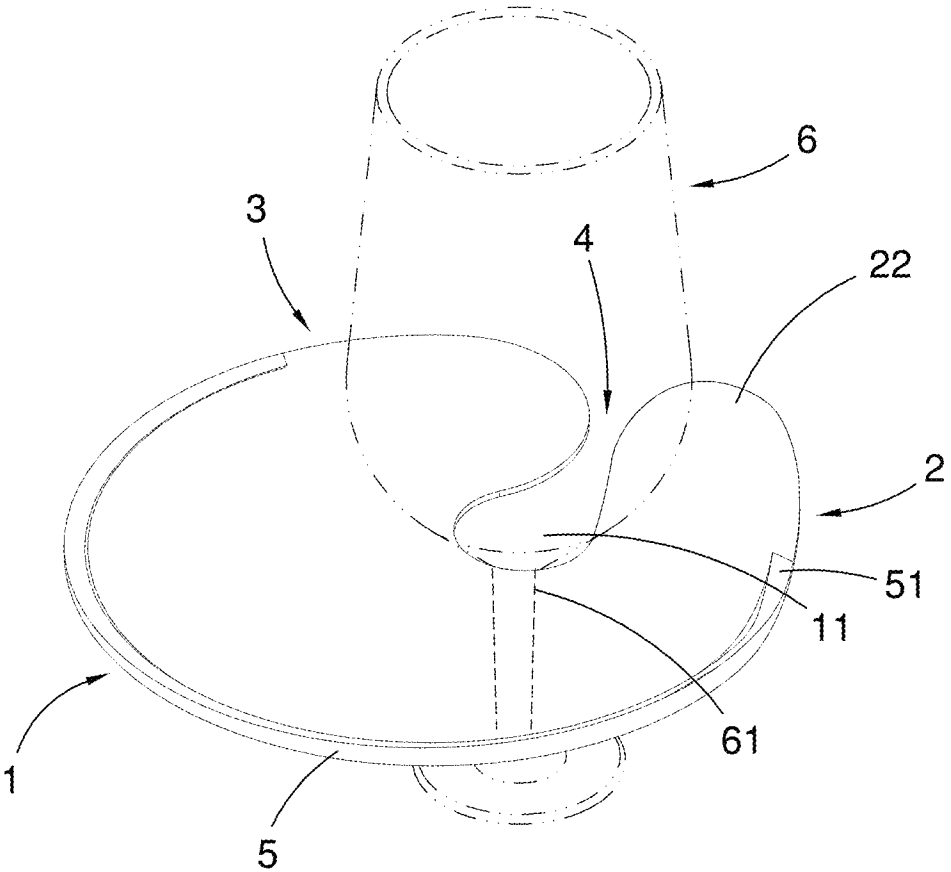
FIG. 3 shows a perspective view of a usage state of the embodiment of the tray of the present invention.

As shown in FIG. 3, when a user holds the tray of the present invention with one hand, the other hand can insert the elongated stem 61 of a stemmed glass 6 into the through hole 11 along the offset channel 4, with the stemmed glass 6 then supported by the edge 12 of the through hole 11. At this point, due to the configuration of the offset channel 4, the stemmed glass 6 is less likely to slip out of the tray, meaning that the user can place pastries onto the tray or eat pastries from the tray with reduced concern that the stemmed glass 6 might slip off. When the user wishes to drink the beverage (e.g., red wine or white wine) in the stemmed glass 6, they simply reverse the operation to remove the stemmed glass 6 and enjoy the drink. Therefore, the tray of the present invention allows people at a banquet or cocktail party to enjoy food and drinks comfortably and elegantly.

Figure 4:
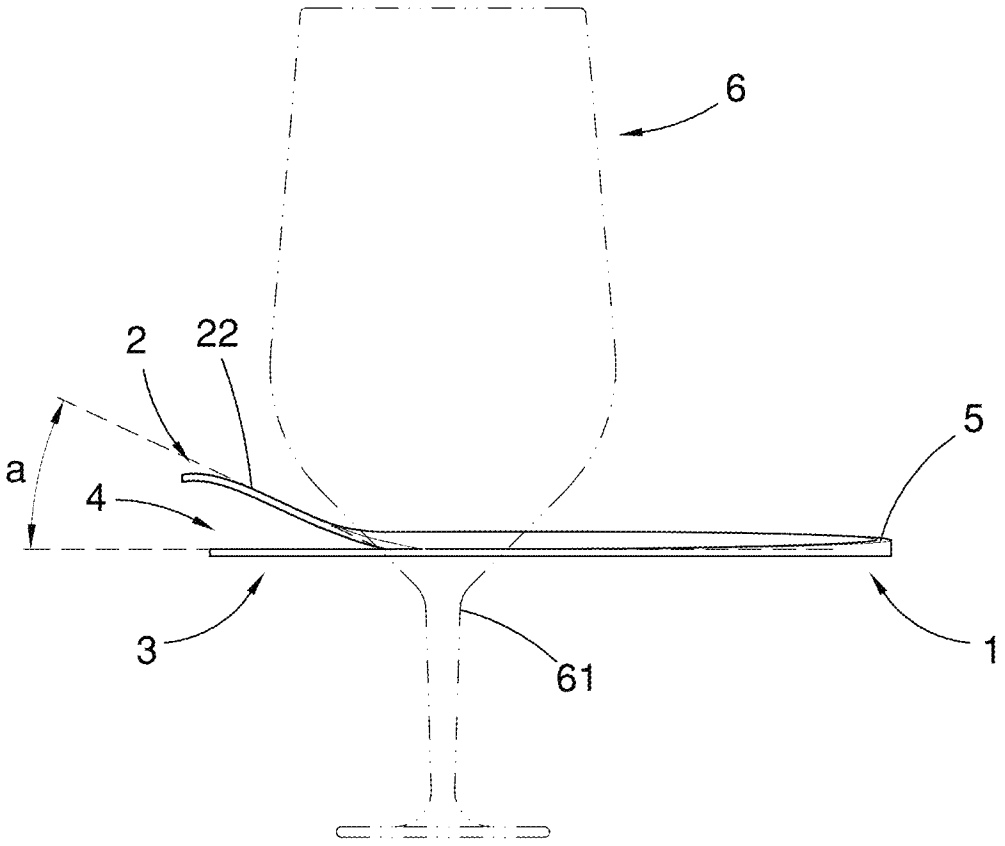
FIG. 4 shows a side view of the usage state of the embodiment of the tray of the present invention.

In this embodiment, as shown in FIG. 1 and FIG. 4, the first extending portion 2 may also be further configured to be upwardly inclined to facilitate the user in handling the tray. Furthermore, as can be seen from FIG. 3 to FIGS. 5, the terminal section 22 of the first extending portion 2 inclines upward and obstructs the stemmed glass 6, making it even less likely for the stemmed glass 6 to slip out of the tray. This allows the user to enjoy food and beverages on the tray more comfortably and confidently.

In this embodiment, as shown in FIG. 4, a sharp angle "a" is formed between the first extending portion 2 and the second extending portion 3. Preferably, the angle "a" is any angle between 5 and 85 degrees, such as 25 degrees or 40 degrees.

Figure 5:
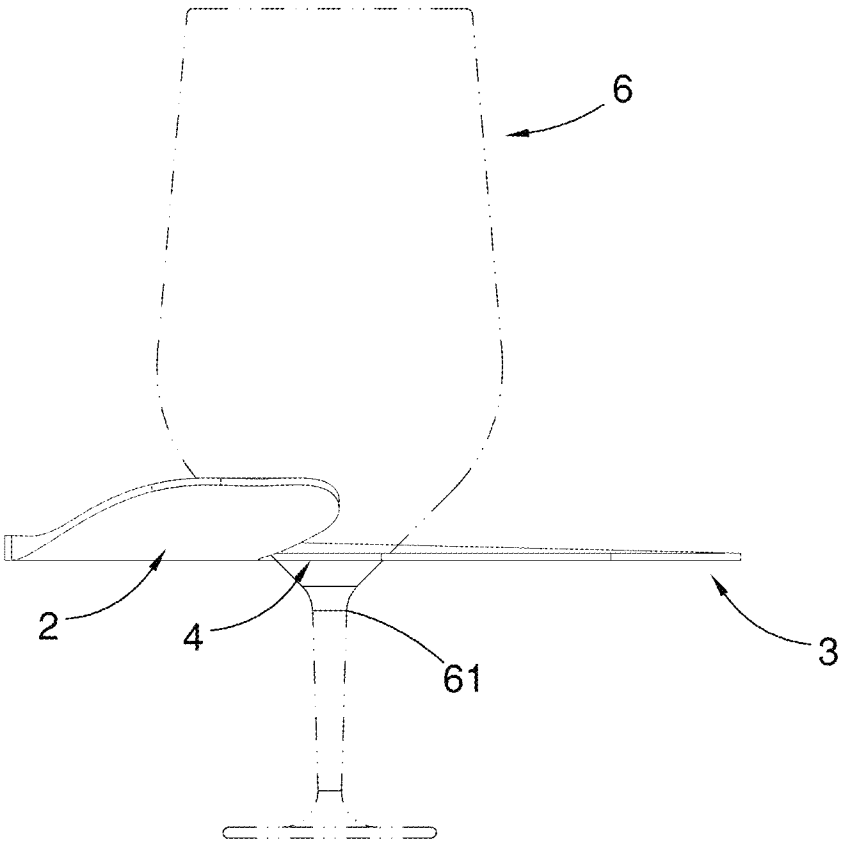
FIG. 5 shows another side view of the usage state of the embodiment of the tray of the present invention.
Figure 6:
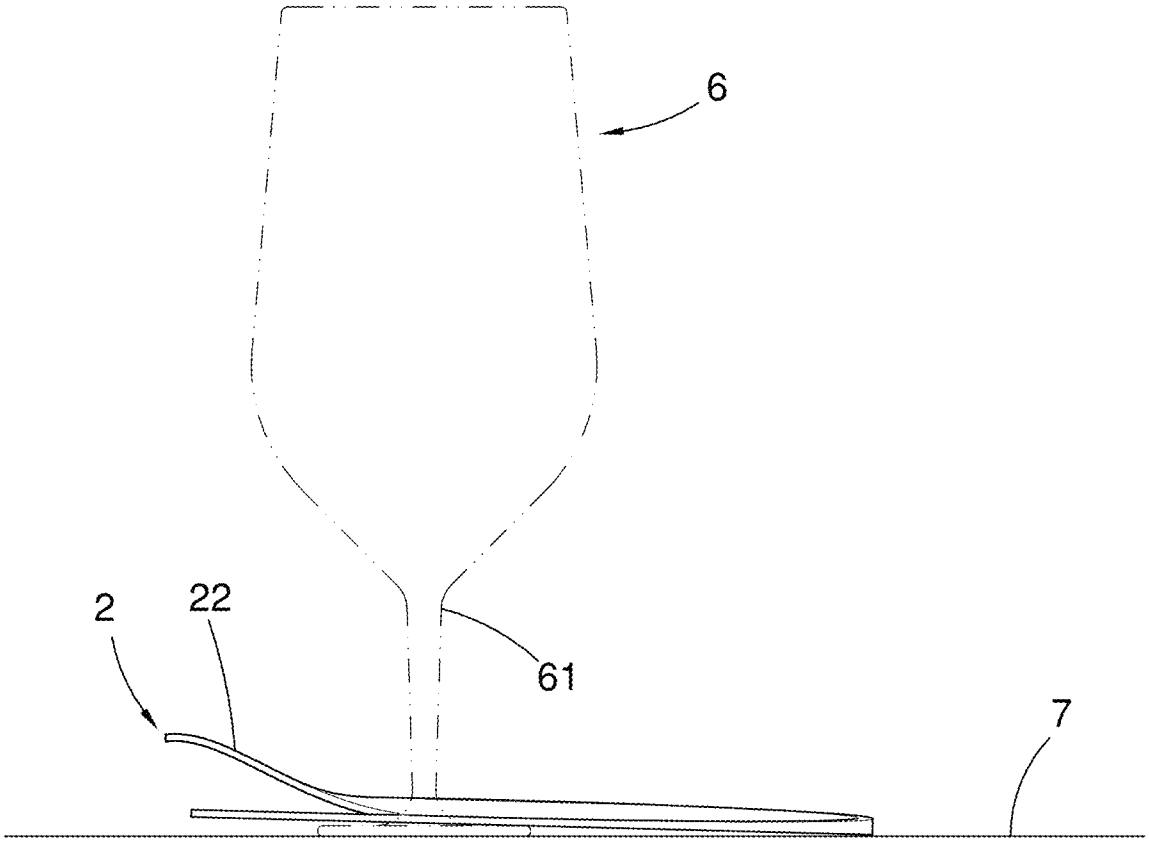
FIG. 6 shows a side view of another usage state of the embodiment of the tray of the present invention.

FIG. 6 shows the tray of the present invention being moved downward along the elongated stem 61 of the stemmed glass 6 onto a tabletop 7, thereby placing the stemmed glass 6 and the tray together on the tabletop 7. Conversely, the tray can be moved upward along the elongated stem 61 of the stemmed glass 6, allowing the tray to securely hold the stemmed glass 6, as illustrated in FIG. 3 to FIG. 5.

Figure 7:
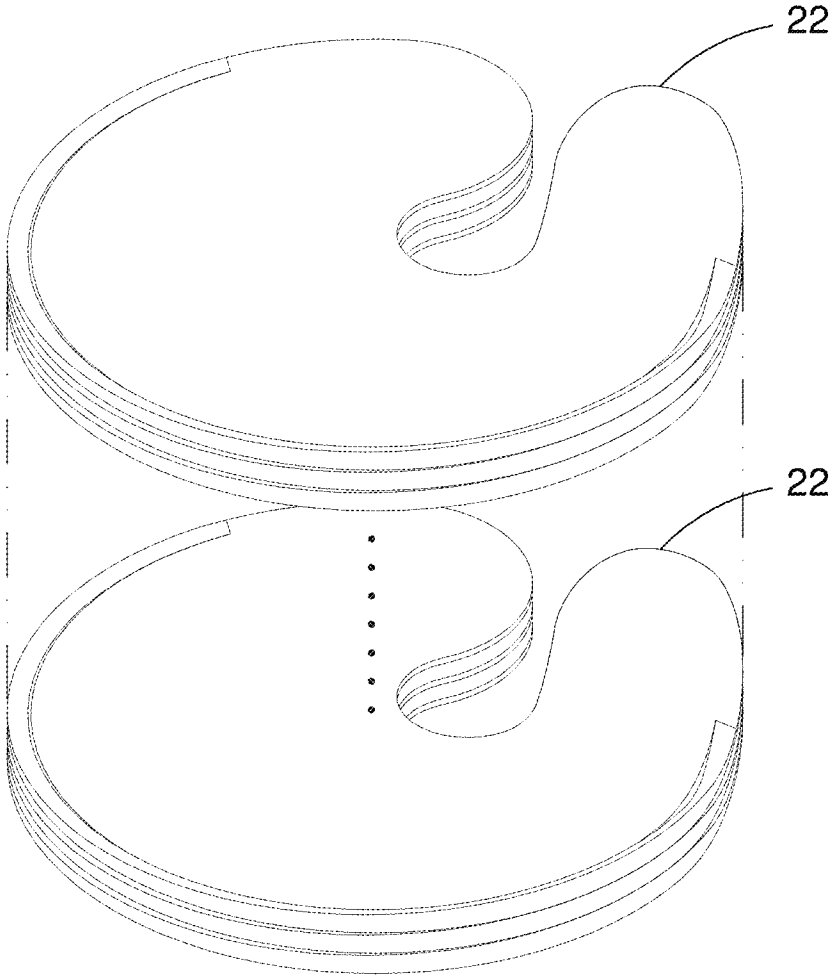
FIG. 7 shows a perspective schematic view of multiple embodiments of the tray of the present invention stacked together.

FIG. 7 shows multiple trays of the present invention stacked together. The upwardly inclined terminal section 22 allows these trays to be stacked securely without easily tipping over.

In this embodiment, as shown in FIG. 2, a portion 21*a* of the inner edge 21 of the first extending portion 2 extends beyond the radial centerline 111. This indicates that the first extending portion 2 has a function of blocking the stemmed glass 6, making it less likely for the stemmed glass 6 to slip out of the tray.

In this embodiment, as shown in FIG. 2, the width of the offset channel 4 first gradually decreases from the notch 13 towards the opening 40 and then gradually increases. This design allows the stemmed glass 6 to be easily inserted into the through hole 11, while making it less likely to slip out of the tray on its own. Preferably, the distance between the inner edge 21 of the first extending portion 2 and the radial centerline 111 is closer compared to the distance between the inner edge 31 of the second extending portion 3 and the radial centerline 111, which further enhances the described effect.

In this embodiment, as shown in FIG. 1, the top surface 10 of the main portion 1, the top surface 20 of the first extending portion 2, and the top surface 30 of the second extending portion 3 are all part of the same continuous surface. Preferably, the top surface 10 of the main portion 1 also features an upwardly protruding blocking wall 5 to reduce the likelihood of food or items placed on the tray from falling off. Additionally, the ends of the blocking wall 5 extend into the top surfaces 20 and 30 of the first extending portion 2 and the second extending portion 3, respectively. More preferably, the height of the blocking wall 5 decreases gradually from the first extending portion 2 towards the second extending portion 3. The width of the top of the blocking wall 5 narrows gradually from the second extending portion 3 towards the first extending portion 2. An inclined surface 51 is formed between the blocking wall 5 and the first extending portion 2, with the inclined surface 51 narrowing upwards and connecting with the top of the blocking wall 5.

The invention claimed is:

1. A tray comprising:

a main portion having a through hole, a hole edge surrounding the through hole, and a notch defined by two ends of the hole edge, with the notch being in communication with the through hole;

a first extending portion extending from the main portion and located on one side of a radial centerline of the through hole in the main portion, wherein a portion of an inner edge of the first extending portion extends beyond the radial centerline, a top surface of the first extending portion and a top surface of the main portion are the same surface;

a second extending portion extending from the main portion and located on the opposite side of the radial centerline, wherein a top surface of the second extending portion and the top surface of the first extending portion are the same surface, wherein a distance between the inner edge of the first extending portion and the radial centerline is smaller than a distance between the inner edge of the second extending portion and the radial centerline;

a blocking wall protruding upward from the top surface of the main portion, with two ends of the blocking wall extending into the top surface of the first extending portion and the top surface of the second extending portion, respectively; and an offset channel defined by an inner edge of the first extending portion and an inner edge of the second extending portion, with one end of the offset channel being in communication with the notch in the main portion, and the other end of the offset channel forming an opening, wherein a width of the offset channel decreases gradually from the notch towards the opening, and then increases gradually.

2. The tray as recited in claim 1, wherein the first extending portion is raised upward.

3. The tray as recited in claim 1, wherein the center point of the through hole is located on the radial centerline, and the center point of the opening is not located on the radial centerline.

4. The tray as recited in claim 1, wherein a height of the blocking wall decreases gradually from the first extending portion towards the second extending portion, and a top width of the blocking wall narrows gradually from the second extending portion towards the first extending portion.

* * * * *